United States Patent [19]

Fafard

[11] 4,139,086

[45] Feb. 13, 1979

[54] SLUG REJECTOR

[76] Inventor: George E. Fafard, 22 Oakland Cir., Abington, Mass. 02351

[21] Appl. No.: 824,546

[22] Filed: Aug. 15, 1977

[51] Int. Cl.[2] ..... G07F 3/02

[52] U.S. Cl. ..... 194/97 A

[58] Field of Search ..... 194/97 R, 97 A, 102, 194/99

[56] References Cited

U.S. PATENT DOCUMENTS 2,003,771 6/1935 Graf ..... 194/97 A

*Primary Examiner*—Stanley H. Tollberg

*Attorney, Agent, or Firm*—Robert E. Ross

[57] ABSTRACT

A slug rejector for use with coin-operated devices, in which a pair of grippers grasp an inserted coin and move it past restraining mechanism to drop it into an entrance chute of the device. The motion of the coin past the restraining mechanism is made possible by engagement of the grippers with the protrusions of the embossed surface of the coin. In the case of a slug, having a smooth surface, the grippers cannot grasp the slug tightly enough to move it past the restraining mechanism, and consequently as the grippers move they slide off of the slug, allowing it to drop into a different chute.

7 Claims, 10 Drawing Figures

SLUG REJECTOR

BACKGROUND OF THE INVENTION

Although coin-operated devices commonly have slug identifying and rejecting means, they are in many cases not effective, since a simple stamped out copper disc the diameter of a coin will be accepted by most of such devices, such as telephones, vending machines, coin-operated washers and dryers, etc., and hence there is a need for a reliable mechanism that will reject such slugs, that can be added to an existing coin-operated device.

SUMMARY OF THE INVENTION

In the illustrated embodiment of the invention a rotatable drum is provided with a peripheral slot to receive a coin which completes an electrical circuit when the coin contacts the hub of the drum. The completion of the circuit causes the drum to rotate through 180°. As rotation starts, a pair of grippers on the drum move together to grasp the coin.

The presence of the embossments on the coin surface allow the grippers to pull the coin along as the drum rotates. A resilient spring arm is disposed in the path of the coin, which must be flexed by the coin as it moves with the drum. After the coin has passed the spring arm, the grippers open and the coin drops into a chute leading into the device to be operated.

If a slug rather than a coin is inserted, force required to pull the coin past the spring arm is great enough to force the grippers to slide off the slug before it can move any appreciable distance when the drum rotates, and the slug then drops into a different chute to be ejected from the machine.

DESCRIPTION OF THE ILLUSTRATED EMBODIMENT

Figure 1:
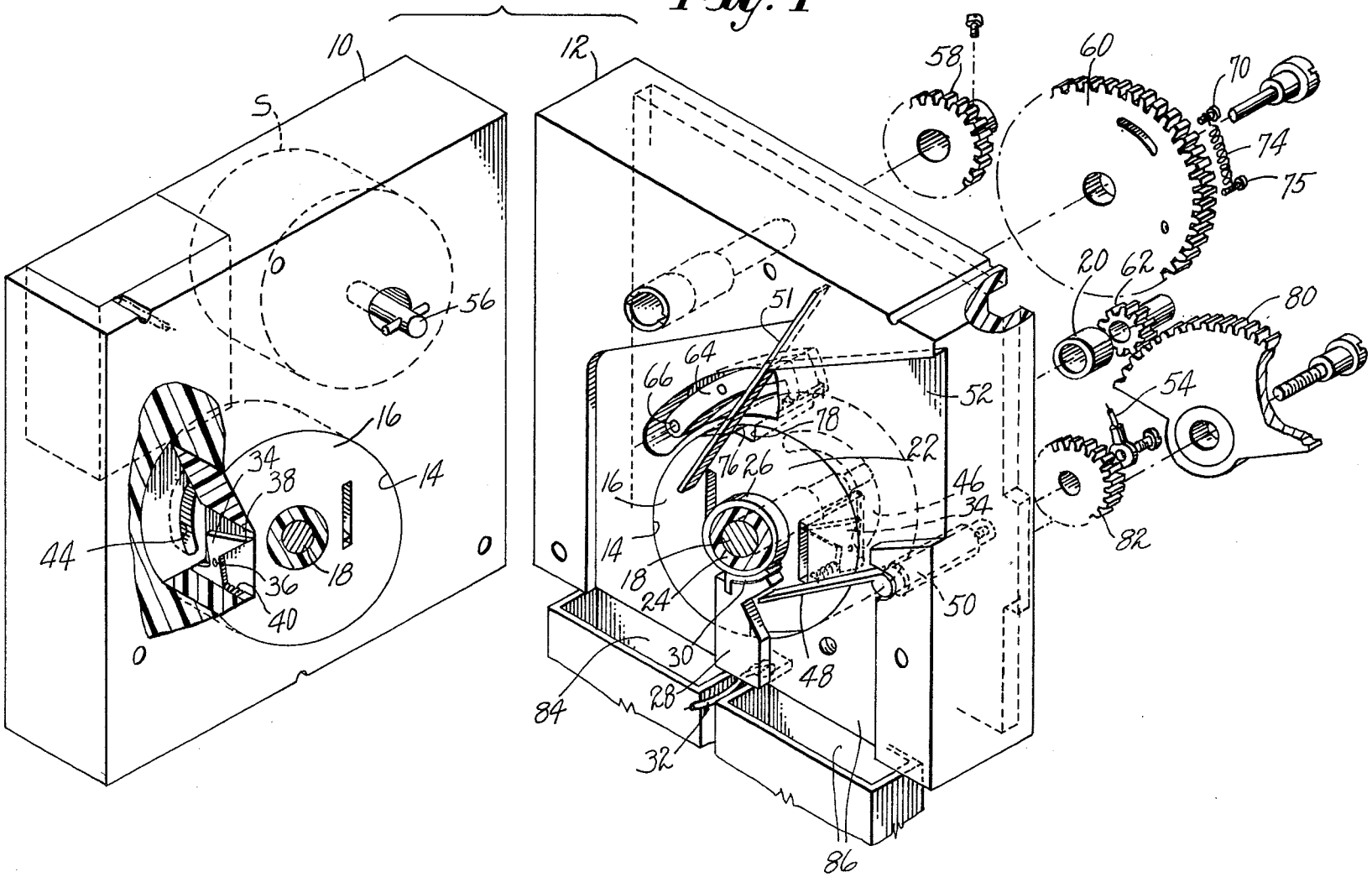
FIG. 1 is a perspective view of the slug-rejecting device showing the interior surfaces of the housing with the components assembled with certain portions broken away for clarity.

Referring to the drawings, there is illustrated a slug rejector which comprises a housing formed by a pair of mating blocks 10 and 12 having recesses in the mating faces thereof forming, when assembled, internal cavities to be described hereinafter. The housing members are preferably formed of nonconductive material such as machined or molded synthetic organic plastic.

Figure 2:
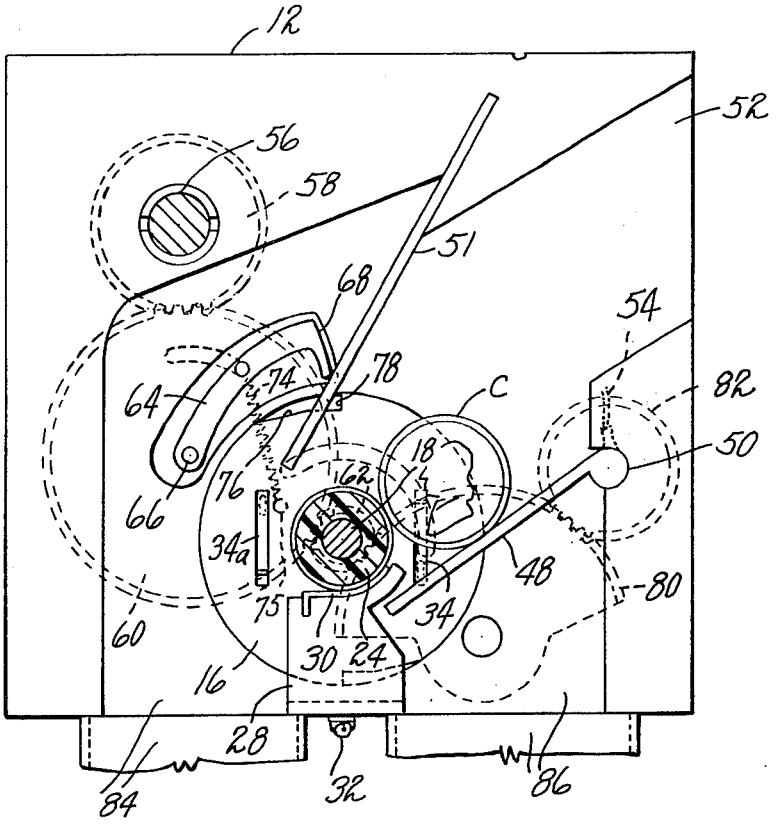
FIG. 2 is a plan view, partly broken away, of the front side of the device, with a coin that has just been inserted into the coin slot.

Recesses in the mating faces of the blocks provide a cylindrical cavity 14, receiving a drum 16 rotatable in the cavity 14 on shaft 18 by means to be described hereinafter. Interposed between the drum 16 and the shaft 18 is a one-way clutch 20 which allows rotation of the drum with the shaft only when the shaft is rotating counter-clockwise as seen in FIG. 2.

The drum 16 is provided with a peripheral groove 22 extending inwardly to a hub 24, which has a surface of conductive material 26. A conductive contact support 28 extends into the groove 22, carrying a leaf spring contact 30, and disposed in resilient contact with the conductive surface 26 of the hub. A lead wire 32 is attached to the support to complete an electrical circuit to the hub.

Figure 3:
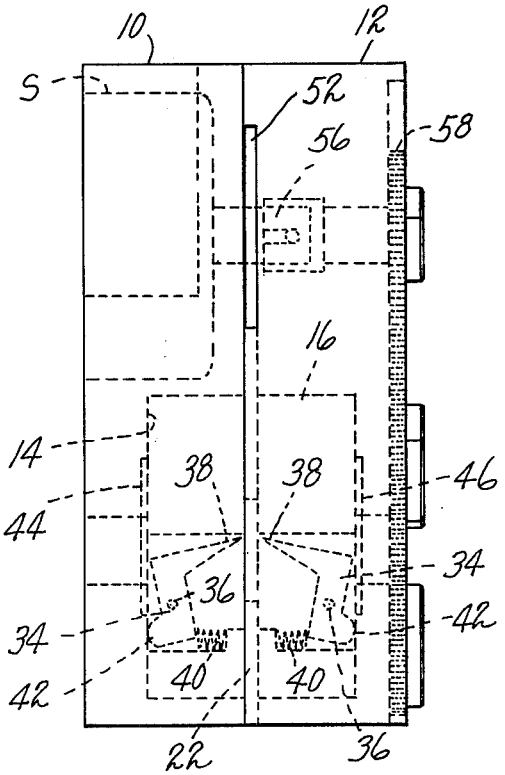
FIG. 3 is a view of FIG. 2 as seen from the right side.
Figure 7:
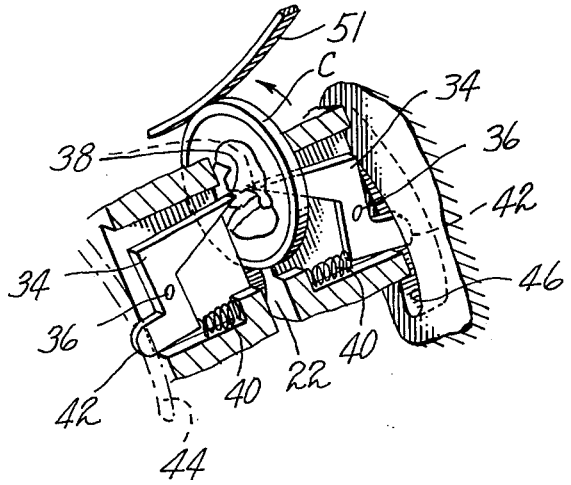
FIG. 7 is an enlarged view of the gripper mechanism and coin in the position of FIG. 5.
Figure 8:
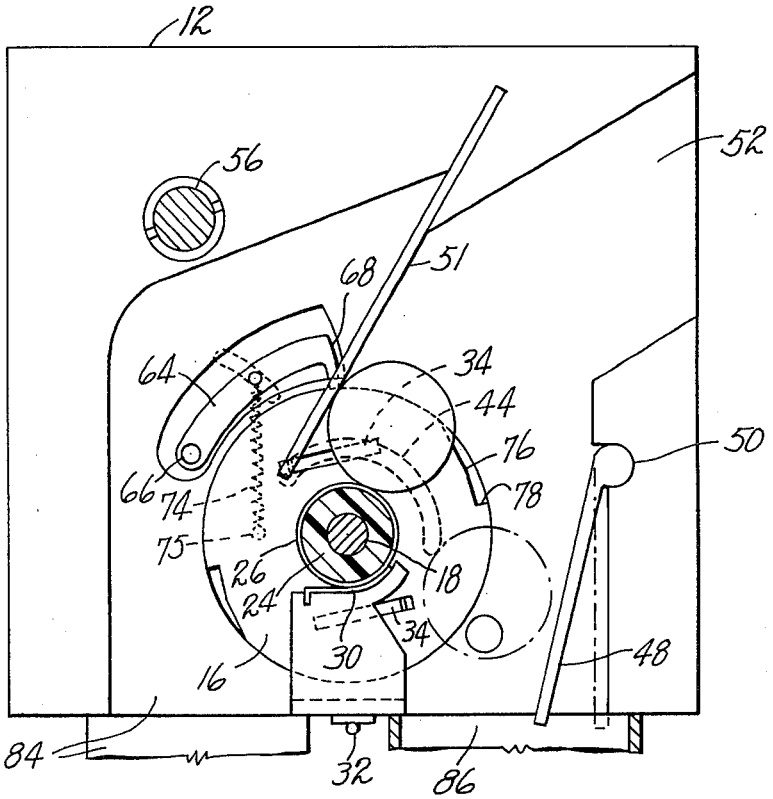
FIG. 8 is a front plan view of the device illustrating the action of the components when a slug is inserted.
Figure 9:
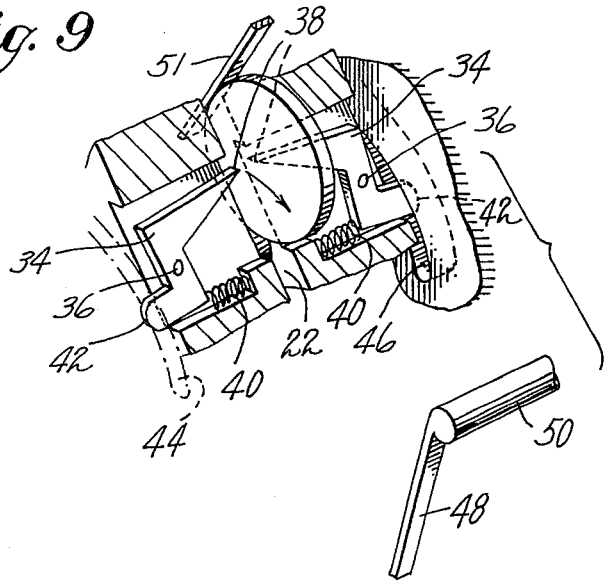
FIG. 9 is an enlarged view of the gripper mechanism and slug of FIG. 8.
Figure 10:
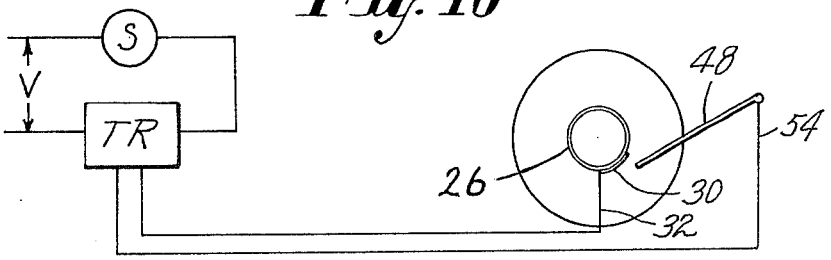
FIG. 10 is a schematic diagram of the electrical circuit of the device.

The hub is provided with two sets of grippers 34 and **34*a* disposed 180° apart. The gripper sets and their method of operation are identical to each other, so only one set will be described. The grippers of each set are mounted on the hub portions on opposite sides of the groove 22 on pivots 36, so that they are movable about the pivots between a first position (see FIG. 7) in which pointed ends 38 thereof extend toward each other into the peripheral groove 22**, and a second position in which the grippers are rotated in opposite directions so that the pointed ends are inclined upwardly (as seen in FIG. 3) and do not extend into the groove.

The grippers are biased to the first position by springs 40, but are maintained in the second position by cam followers 42 which extend from the grippers into contact with the adjacent face of the blocks 10 and 12 when the device is in the at rest condition.

Semi-circular grooves 44 and 46 are provided in the faces of the housing members 10 and 12 respectively in the ends of the cavity 14, so positioned that when the drum rotates (counter-clockwise) the cam followers 42 move outwardly into the grooves allowing the pointed ends 38 of the grippers to move toward each other and grip the inserted coin or slug therebetween, as will appear hereinafter.

Also extending into the groove 22 is a coin support bar 48 extending from a rotatable shaft 50 mounted in the block 12, and a cantilever leaf spring 51.

The spring 51 extends from the upper portion of the block 12 and is inclined forwardly (in relation to the direction of rotation of the drum) so that the free end portion thereof is disposed in the groove in the path of travel of a cam being carried by the drum, for a purpose to appear hereinafter.

The support bar 48 is normally disposed in the position shown in FIG. 1, where it serves as a support for an inserted coin.

A coin slot 52 is provided in the block 12 in alignment with the groove 22 and the support bar 48 and the angle of the bar 48 is such that a coin or slug inserted into the slot 52 rolls down onto the bar into contact with the drum hub 24. An electrical lead 54 is attached to the shaft 50, so that when the coin, resting on the bar, touches the conductive surface of the hub, an electrical circuit is completed between the two lead wires.

Figure 4:
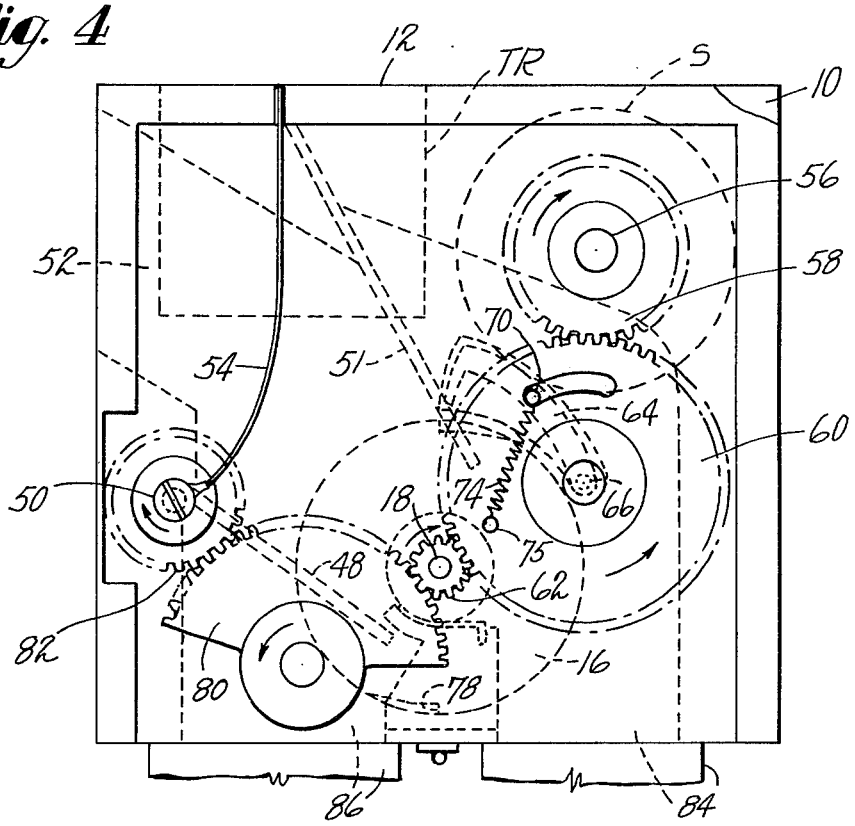
FIG. 4 is a plan view, partly broken away, of the rear side of the device in the condition of FIG. 1.

The completion of the circuit between the lead wires 32 and 54 completes a circuit from a suitable power source such as an ordinary 110 V supply (not shown) to a rotary solenoid S, of the type that rotates an output shaft 56 through 45° when energized, and returns by reverse rotation to its original position. The output shaft 56 rotates gear 58 clockwise (as seen in FIG. 4) which rotates idler gear 60 counter-clockwise, which rotates gear 62 on the drum shaft 18 clockwise through one-way clutch 20.

As previously mentioned, in the illustrated embodiment of the invention, the drum 16 is provided with two sets of coin-receiving grippers 180° apart to speed up the operation of the device, so that on insertion of a coin, the drum need rotate only 180° to complete its cycle and be in the proper orientation to receive the next coin.

For this reason, the gear ratio between the solenoid shaft and the drum shaft is 4-1, so that when the solenoid shaft turns 45°, the drum shaft and the drum will turn 180°.

To prevent the inertia of the various rotating components from causing the drum 16 to rotate more than 180° on each cycle, positive stop means for the drum is provided, which comprises a pawl 64 disposed on the side of the idler gear 60 and secured thereto by a pivot 66 at one end, the other end having a downwardly extending stop 68. The pawl carries a pin 70 projecting through a slot 72, and the pawl is biased to the downward position by a spring 74 extending between the pin 70 and a pin 75 on the gear 60.

During the standby condition the gear 60 is in the orientation shown in FIG. 4 with the pin 70 resting in the bottom of the slot 72, and the stop portion 68 disposed above the surface of the drum 16.

The periphery of the drum portion adjacent the gear 60 is provided with two cam surfaces 76 which progress inwardly from the drum surface to terminate in radial abutments 78 180° apart. On rotation of the gear 60 (counter clockwise as seen in FIG. 4) during the operating cycle, the stop 68 moves downwardly in relation to the pin 70, extending the spring 74. As the drum rotates the stop 68 rides on a cam surface 76 and at the end of the rotary motion of the solenoid, the stop contacts an abutment 78 preventing further motion of the drum.

The rotation of the solenoid also causes, through segment idler gear 80, rotation of gear 82 on shaft 50 in a clockwise direction, (as seen in FIG. 4) which turns the support bar 48 downwardly through an angle of 60°.

On de-energization of the solenoid, it returns to its original orientation, rotating idler gear 60 to its original position (FIG. 4), lifting the pawl so that the stop 68 lifts out of engagement with the abutment 78 and returning the support bar 48 to its original position.

However, the drum 16 does not rotate back to its original position because of the one-way clutch 20, but remains in the orientation at which it was stopped by the contact of the pawl with the abutment.

The complete operating cycle of the machine will now be described.

When the machine is in the at-rest or standby condition, the support bar 48 extends into the drum groove 22 and is inclined downwardly, and the orientation of the drum is such that the cam followers 42 of the grippers 34 are bearing against the adjacent drum surface near the ends of the semicircular grooves 44 and 46, so that the grippers are held in the upwardly inclined or open position, with the ends 38 thereof not projecting into the groove 22.

A coin C inserted into the slot 52 rolls down the support bar 48 until it contacts the conductive surface 26 of hub 24, which completes the electrical circuit to the solenoid S, starting rotation of the gears.

As the drum 16 starts to rotate, the pawl moves downwardly to bear against the drum surface, and the support bar 48 starts to move downwardly. After the drum has rotated about 4° the grippers move together to grasp the coin therebetween. Depending on the type of coin and its orientation the grippers may slide on the coin a short distance until the grippers encounter an outwardly projecting embossment thereon, which may be a portion of the design embossed on the coin or the raised rim, after which point the coin moves with the grippers as the drum rotates.

Figure 5:
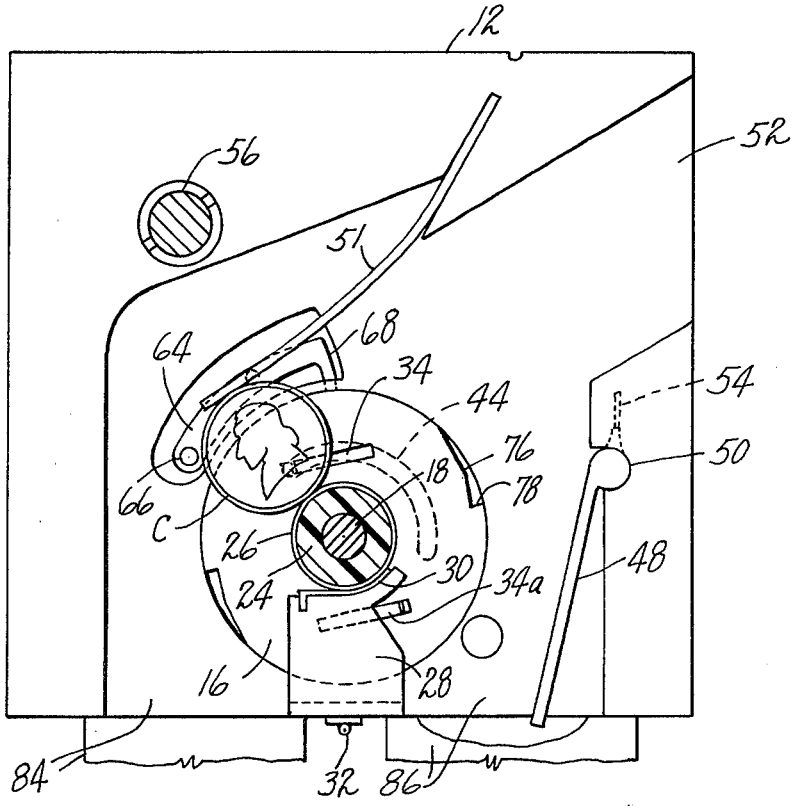
FIG. 5 is a view similar to FIG. 2 in which the coin has been carried by the device to the position where it is ready to drop into the coin exit slot.
Figure 6:
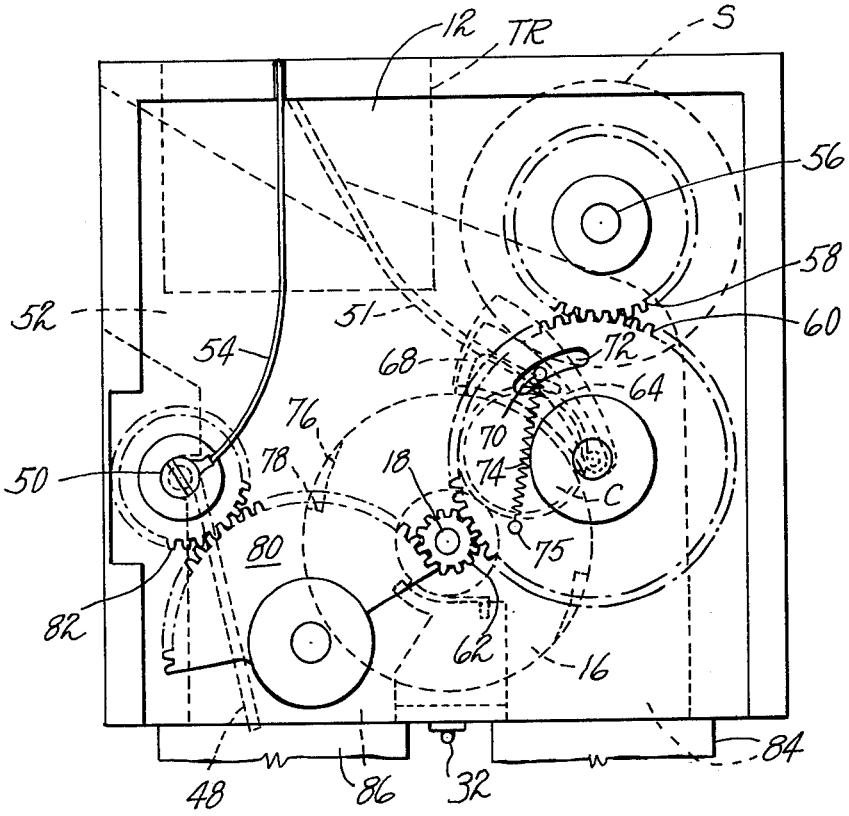
FIG. 6 is a view of FIG. 5 as seen from the rear side.

After the drum has rotated about 45 degrees, the coin contacts the free end of the spring 51. For the coin to continue to travel with the drum, the grippers must be able to apply sufficient lateral force to the coin to enable it to flex the spring 51 far enough to the left (FIG. 5) to allow the coin to pass. The required force can be applied only to coins having adequate surface protrusions. If the coin meets this requirement, it is carried by the drum to the far side of the drum hub.

At this point the cam followers 42 reach the ends of the semi-circular grooves 44 and 46 and are forced inwardly, pivoting the grippers to the open position and allowing the coin to drop out of a coin exit slot 84.

During the rotation of the drum, the support bar has rotated downwardly so that it is no longer positioned to support the coin if the coin is not picked up and carried by the grippers.

Once the coin has been lifted out of contact with the support bar, the circuit between the two lead wires 32 and 54 is broken; however, the circuit to the solenoid is maintained by, for example, a time delay T or by any other convenient method, for a time sufficient to allow the solenoid to complete its 45° rotation.

After the coin has been dropped, the drum has stopped rotating, and the solenoid de-energized by the timing out of the time delay, the solenoid reverses rotation to its original orientation under the force of an internal spring (not shown), returning the gear components to their original position.

The drum, however, remains in the position at which it has come to rest, with the other set of grippers 34*a* positioned to receive the next coin.

If a slug having a smooth surface is inserted into the device, it rolls down the support bar to complete the electrical circuit in the same manner as a coin. However, when the drum rotates to cause the grippers to grasp the slug therebetween, the lack of surface embossments provides inadequate lateral driving force to the slug, which may allow the grippers to slide across the slug surface and off the edge thereof. Since the support bar 48 has pivoted downwardly as the drum is rotating, at or about the time the grippers have moved off the slug surface, the bar 48 has reached a position that will allow the slug to drop out of the housing on the near side of the drum hub through exit slot which discharges the slug from the machine.

However, if the slug has sufficient roughness to enable the grippers to carry it through the initial portion of the drum rotation, they will not have sufficient gripping strength to carry it past the spring 51. Further rotation of the drum after the slug has contacted spring 51 will force the slug out from between the gripper on the near side of the drum hub to cause the coin to drop into a reject slot 86.

It is apparent that smooth coins as well as slugs may be rejected by the machine. However, this feature is not objectionable, so long as all slugs are rejected.

One of the features of the invention that makes it very effective in rejecting slugs is the speed of rotation of the drum when the solenoid is energized. Some slugs have a burr around the periphery resulting from the blanking operation. If the drum were rotated slowly enough, it might be possible for the grippers, by contacting the burr, to carry the slug to the opposite side of the hub to be dropped into the coin slot 72. However, the rotation of the solenoid is completed within a fraction of a second, and to stay within the grippers, the coin or slug must be accelerated from rest to the drum speed before the grippers have moved from the point of contact with the coin to the edge. It has been found that when a slug with a substantial burr is inserted into the machine, the grippers which, in the preferred embodiment are made of hardened steel, actually tear a path through the burr, leaving the slug to drop into the exit chute. Slugs with a roughened surface will also be rejected by the machine, provided that the configuration of the roughness does not resemble the embossed surface of a coin. The expense of manufacturing an embossed slug that would be accepted by the machine would require dies and machinery not readily available to the type of person usually involved in slug manufacture.

The device is capable of rejecting slugs of a size corresponding to all common coin sizes. The slugs that are most commonly used, and those causing greatest loss to the vending machine owner, are those matching the size of a quarter. Since these slugs have a greater mass than smaller slugs, they are more difficult to accelerate and therefore even less likely to be accepted by the above-described device than smaller slugs.

Although in the illustrated embodiment, the drum rotates through 180° on each cycle, with two sets of grippers being provided, it will be understood that if desired, the drum could, with minor mechanical and structural changes, be made to rotate through 360° on each cycle.

In other modifications of the invention, means could be provided for pulling the coin by suitable grippers along a straight path, with a suitable flexible obstruction being disposed in the coin path.

It will be understood that in some installations, in which the device described herein is used as an attachment to an existing vending machine or the like, the coin may drop into the regular coin entrance slot of the machine, or if the herein-described mechanism is incorporated into a coin-operated machine when originally built, the coin may be dropped directly into the machine actuating mechanism.

Since certain other modifications in the herein-illustrated specific embodiment of the invention may be made without departing from the scope thereof, it is intended that all matter contained herein be interpreted in an illustrative and not a limiting sense.

I claim:

1. A slug-rejecting device, comprising means for grasping a metal disc, such as a coin or slug by contacting both faces thereof, means for thereafter moving the grasping means along a predetermined path, means positioned in the path of the coin or slug carried by the grasping means to create a resistance to travel of the coin or slug past said means, said resistance being greater than the lateral force needed to force a smooth-faced disc out from between the grasping means, but less than the force needed to force a disc having surface embossments such as are on coins.

2. A slug-rejecting device as set out in claim 1 in which said grasping means comprises a pair of opposing members at least one of which is movable between an open position in which a coin or slug can pass freely between the members and a closed position in which they are spring-biased together to engage opposite faces of a coin or slug disposed therebetween.

3. A slug-rejecting device as set out in claim 1 in which the portion of the grasping means that contacts the disc surface is formed of a material and so shaped as to have a low coefficient of friction against the surface of a metal coin or slug.

4. A slug-rejecting device, comprising opposing grippers for grasping a metal disc such as a coin or slug therebetween by contacting both faces thereof, said gripper means having an open position to receive the disc therebetween and a closed position in which a disc disposed therebetween is grasped so as to be laterally slidable between the grippers when a sufficient lateral force is applied thereto, said grippers normally being in the open position, means accelerating said open grippers along a predetermined path, means positioning a disc in the path of the opening between the grippers, means thereafter moving said grippers to the closed position as they pass over the disc, and means disposed in the subsequent portion of the path of the disc to apply a force thereto tending to restrain further movement of the disc along said path, said force being great enough to cause the grippers to slide along a smooth disc such as a slug but not great enough to cause said grippers to slide over a disc having protrusions such as are found on a coin.

5. A slug-rejecting device as set out in claim 4 in which the end portions of the grippers that contact the disc surface are formed of material having a low co-efficient of friction against metal, and being dimensioned to enable said portions to engage an area on a coin surface which is smaller than the flat un-embossed area thereof.

6. A slug-rejecting device, comprising a rotatable drum having a circumferential slot, means for supporting a disc such as a coin or slug in the slot, opposing gripper means mounted on opposite sides of the slot and having an open position in which they do not project into the slot and a closed position in which they grip a disc disposed therebetween by contacting both faces thereof, means causing rotation of said drum and movement of the grippers to the closed position whereby a disc disposed in the slot on the supporting means is carried by the drum, and resilient spring means extending into the slot into the path of the disc, said spring being positioned and dimensioned to apply a restraining force to the disc which is great enough to restrain a smooth disc such as a slug from further movement along the path with the grippers but not great enough to prevent the further forward movement of a disc having surface embossments such as are on coins.

7. A slug-rejecting device as set out in claim 6 in which said drum is provided with two pairs of opposing gripper means disposed 180° apart on said drum, and means is provided limiting the rotation of said drum to 180° on each cycle of the device.

* * * * *